US006148958A

United States Patent [19]

Ahl et al.

[11] Patent Number: 6,148,958

[45] **Date of Patent: *Nov. 21, 2000**

[54] LADDER SUPPORTED HOLDING TRAY WHICH EXTENDS OUTWARDLY FROM A LADDER

[76] Inventors: Frank E. Ahl, P.O. Box 41; Brian E. Ahl, P.O. Box 154, both of Elliston, Mont. 59728

[ * ] Notice: This patent issued on a continued prosecution application filed under 37 CFR 1.53(d), and is subject to the twenty year patent term provisions of 35 U.S.C. 154(a)(2).

[21] Appl. No.: 08/768,864

[22] Filed: Dec. 17, 1996

Related U.S. Application Data

[63] Continuation-in-part of application No. 08/757,775, Nov. 26, 1996, Pat. No. 5,842,253.

[51] Int. Cl.[7] ..... E06C 7/14

[52] U.S. Cl. ..... 182/129; 182/121; 182/122; 248/210; 248/238

[58] Field of Search ..... 182/129, 122, 182/121; 248/210, 211, 238; 220/570

[56] References Cited

U.S. PATENT DOCUMENTS

| | | | |
|---|---|---|---|
| D. 347,306 | 5/1994 | Rogers et al. | D32/53.1 |
| 2,051,060 | 8/1936 | Soman | 182/120 |
| 2,308,180 | 1/1943 | Larsen | 248/238 |
| 2,412,567 | 12/1946 | Dodd | 248/210 |
| 2,473,951 | 6/1949 | Hickery | 248/210 |
| 2,598,479 | 5/1952 | Wraith | 248/211 |
| 2,759,620 | 8/1956 | Pharris | 248/211 |
| 2,766,957 | 10/1956 | Nelson | 248/211 |
| 2,818,310 | 12/1957 | Campbell | 182/121 |
| 2,883,134 | 4/1959 | O'Halloran | 248/210 |
| 2,930,442 | 3/1960 | Carter . | |
| 3,103,334 | 9/1963 | Thoms | 248/238 |
| 3,313,506 | 4/1967 | Bauchard | 248/210 |
| 3,822,846 | 7/1974 | Jesionowski | 248/210 |
| 3,822,847 | 7/1974 | Emmons | 248/210 |
| 3,850,298 | 11/1974 | Jolly | 220/570 |
| 3,979,097 | 9/1976 | Balne | 248/211 |
| 4,013,251 | 3/1977 | Cleveland | 248/210 |
| 4,222,541 | 9/1980 | Cillis | 248/210 |
| 4,424,949 | 1/1984 | Kimmett et al. | 248/238 |
| 4,515,242 | 5/1985 | LaChance | 248/238 |
| 4,523,733 | 6/1985 | Lunden, Jr. | 248/210 |
| 4,527,763 | 7/1985 | Woytowich | 248/238 |
| 4,660,794 | 4/1987 | Given | 248/238 |
| 4,913,394 | 4/1990 | Schmid | 248/238 |
| 4,949,809 | 8/1990 | Levi | 182/172 |
| 5,031,723 | 7/1991 | Hooten | 182/129 |
| 5,060,755 | 10/1991 | Bourdages | 182/121 |
| 5,191,954 | 3/1993 | Ledford | 182/129 |
| 5,236,161 | 8/1993 | Haven | 248/210 |
| 5,461,752 | 10/1995 | Lemon et al. | 15/257.06 |

FOREIGN PATENT DOCUMENTS

| | | | |
|---|---|---|---|
| 3429033 | 2/1986 | Germany . | |
| 2130282 | 5/1984 | United Kingdom | 182/129 |

*Primary Examiner*—Alvin Chin-Shue
*Attorney, Agent, or Firm*—Jerry Johnson

[57] ABSTRACT

The ladder supported holding tray assembly for releasable attachment to a ladder includes a generally horizontal container including opposing side panels, a front, a back, and a bottom. The tray assembly also includes a ladder attachment bracket including a connecting wall attaching the bracket to a side panel of the tray. Step engagement means are disposed on the bracket, wherein the step engagement means comprises an upward sloping surface to releasably engage and securely hook onto a step from underneath the step. The tray when mounted on a ladder extends laterally outwardly from the ladder so as to not interfere with the normal use of the ladder.

12 Claims, 4 Drawing Sheets

LADDER SUPPORTED HOLDING TRAY WHICH EXTENDS OUTWARDLY FROM A LADDER

BACKGROUND

The present application is related to copending application Ser. No. 08/731,442 filed Oct. 15, 1996, entitled "Ladder Supported Holding Tray". This application is a continuation-in-part of application Ser. No. 08/757,775, filed Nov. 26, 1996, Pat. No. 5,842,253, issued Dec. 1, 1998, entitled "Ladder Supported Holding Tray for a Paint Roller". Both copending applications are by the same inventors as the present application. These applications are incorporated herein by this reference.

Ladder supported holding trays suitable for holding hardware or paint have existed in various configurations. These trays typically utilize support members that permit temporary attachment of the tray to a step ladder or an extension ladder. A common problem associated with ladder supported holding trays is that such trays are often specifically designed to attach to a single type of ladder. Furthermore, these ladder supported holding trays often only permit attachment to a specific configuration of step ladder or a specific configuration of extension ladder. As many variations of ladders exist in the marketplace there can be difficulty in finding a proper holding tray that the ladder will accommodate.

Another problem associated with typical ladder supported holding trays has been the attachment means utilized to secure the trays to a ladder. These trays typically require attachment either to two steps of a step ladder; to a step of a step ladder and the ladder rail; or to two spaced apart rungs or an extension ladder. Other tray designs attach to the ladder rail only but require some disassembly and reassembly to do so or require the use of fasteners. Due to the variations in ladder construction, the supporting members of the trays often have to be adjusted when possible to securely attach the tray to a ladder. Where adjustment isn't possible often the tray cannot be utilized with particular ladders.

Existing ladder supported holding trays are often problematic to mount on a ladder because of the necessity to attach at more than one point on the ladder. Additionally, most ladder supported holding trays require the user to hold the tray with one hand, while attaching the tray to the ladder with a second hand. This is particularly difficult when the attachment means includes fasteners. It is both difficult and dangerous to devote both hands to mounting a holding tray to a ladder when the user is standing on the ladder. If the ladder supported holding tray mounts in a manner where the tray is not centered on the ladder but is cantilevered off the ladder and attaches to the ladder rail, the attachment process becomes even more difficult and dangerous. In an arrangement of this type the user must lean away from the ladder while holding the tray while also fastening the tray to the ladder.

Existing tray designs that utilize a single step for attachment typically utilize a support on the tray which can be attached to a single rung or step and from which the tray hangs. A problem associated with this design is the lack of stability of a tray that can easily be accidentally moved in relation to the ladder. Furthermore, the support devices used to hang the tray are located above the tray container and often block access to the container portion of the tray. Tray supports of this type often do not have a secure attachment to the tray, as well, and allow the tray to swing in relation to the support if the support is used to carry the tray up or down the ladder.

An additional problem with existing ladder supporting trays is the instability of the holding tray when the trays are not in attachment to a ladder. Filling a tray with paint or other items is difficult as the user must somehow support the tray to do so. Use of a tray of this type when off the ladder is extremely restricted and often not even possible.

Still another problem with existing ladder supported holding trays is the absence of a suitable handle. Many trays do not have a handle and require the user to grab on to the tray wherever possible. This is problematic to the user who is required to both hold the tray while moving up and down the ladder, and to hold the tray while securing the tray to the ladder. Not finding an adequate area to hold on to the tray can be both difficult and dangerous to the user while moving the tray or securing it to the ladder.

Tray designs that do utilize a handle have problems associated with the use of the handle. Many handles also additionally serve as the support from which the tray hangs. In this design the handle is typically located above the tray and often obstructing the user from the tray itself. Furthermore, the tray is allowed to swing from a handle of this type which is typically non-fixed and pivots freely about the tray. The user in this case has to carefully keep the tray from swinging and losing the contents of the tray. Additionally, the user of a tray of this type has to mount the handle onto a step or rung and then somehow remove his or her hand from the handle once the handle is attached to the ladder.

Other tray designs that also include a handle make the handle only useful when moving up or down the ladder. The handle in these tray designs is often unusable during the mounting of the tray on the ladder. This requires the user to hold onto a different portion of the tray during securement of the tray to the ladder, a process which is both difficult and dangerous when standing atop a ladder.

Because of the aforementioned reasons there is a need for a ladder supported holding tray that securely and easily mounts and dismounts to different types of ladders and, will securely mount to a step ladder, to an extension ladder when fully extended, or to an extension ladder in a position when the ladder sections are overlapping. There is also a need for a ladder supported holding tray that includes a tray portion that extends laterally outwardly from the ladder so as not to interfere with the normal operation of the ladder. There is a further need for a ladder supported holding tray that allows the user to mount the tray with one hand only and includes no fasteners and additionally includes no support member that will obstruct the user from accessing the container portion of the tray. There is still further need for a ladder supported holding tray that is self supporting when the tray is not attached to a ladder; and, provides a secure handle for easily holding the tray while moving the tray, or while securing the tray to a ladder which does not interfere with utilizing the tray once mounted to a ladder.

SUMMARY

The ladder supported holding tray assembly of the present invention satisfies all of the aforementioned needs for a ladder supported holding tray.

The ladder supported holding tray assembly for releasable attachment to a ladder includes a generally horizontal container including opposing side panels, a front, a back, and a bottom. The tray assembly also includes a ladder attachment bracket including a connecting wall attaching the bracket to a side panel of the tray. Step engagement means are disposed on the bracket, wherein the step engagement means comprises an upward sloping surface to releasably engage and securely hook onto a step from underneath the step. The tray when mounted on a ladder extends laterally outwardly from the ladder so as to not interfere with the normal use of the ladder.

The step engagement means alone permit secure temporary attachment of the tray to a step of a ladder, when the step comprises a step of a step ladder, or adjacent side by side rungs of overlapping sections of an extension ladder. The connection wall is typically inclined in relation to the tray and includes a forward facing first side and a rearward facing second side that provides a ladder rail abutment surface. When a step comprising a single rung of an extension ladder is engaged by the step engagement means the tray will not rotate about that step as long as the ladder rail abuts the second side of the connection wall.

The upward sloping surface is typically concave. The upward sloping surface further typically includes means to prevent movement of the step engagement means in relation to a step that comprise a series of ridges disposed on the upward sloping surface. The bracket comprises an upstanding wall having a front, a back, a top, and a bottom. The bracket additionally includes a connecting wall attached to the front of the bracket. The step engagement means originate at a position on the bracket proximate to the connecting wall and extends therefrom in an upward sloping orientation to the back of the bracket. The step engagement means is also separated from the top portion of the bracket by a step receiving recess defined by a gap between the upward sloping surface and the top portion of the bracket.

The tray container typically includes a paint basin and a rolling surface and additionally typically includes a handle disposed under the tray bottom. The tray assembly may additionally include a handle attached to the opposing sides of the tray and disposed intermediate the opposing sides of the tray. The container front may also typically include paint roller handle retention means.

The ladder supported tray assembly of the present invention includes new features providing benefits heretofore unrealized by prior art tray designs. A first benefit of the tray assembly of the present invention is the ability of the tray to be easily mounted to a single step of a step ladder, to adjacent side by side rungs of overlapping sections of an extension ladder, or to a single rung of a step ladder in an extended condition. The user of the tray assembly needs only to choose which step, rung, or set of rungs to support the tray and then to slide the tray assembly onto that step, rung or set of rungs. The tray assembly requires no fasteners or the manipulation of adjustable supports to mount it securely. The procedure for mounting the tray is extremely easy and requires just one hand allowing the user to maintain balance on the ladder by maintaining contact with the ladder with the other hand. The process for mounting the tray assembly to a ladder only requires a slight tilting of the tray to slide the step or rungs into the recess separating the step engagement means and the container bottom.

The step engagement means include an upward sloping surface that is typically concave that allows the tray assembly to lock itself to the step or rungs to which it is engaged. Once engaged the upward sloping surface of the step engagement means prevent a lateral force from moving the tray in relation to the ladder. The tray assembly is resistant to upward or downward forces, as well. Nevertheless, the tray assembly is easily removed from a step or set of rungs. The user must only tilt the tray to release the tray from the step while moving the tray assembly away from the ladder.

The tray assembly of the present invention includes the additional benefit of including no structural elements or support members that would interfere with access to the container portion of the tray in use. The entire supporting structure of the tray assembly for mounting the tray on a ladder is a bracket that is attached to a side panel of the tray. As such, no structural or supporting elements of the tray are adjacent to the container top. The side panels and the bracket also provide a suitable structure for supporting the tray on a flat surface if the user desires to use the tray assembly away from a ladder.

A further benefit of the tray assembly of the present invention is the provision of a handle attached to the container bottom. The handle provides a secure attachment point for the user, and allows the user to easily move with the tray up and down a ladder. The handle located along the container bottom does not obstruct the container top as many handles do. The handle which is fixed and non-pivoting does not permit the tray to swing and possibly spill the contents from the container during movement. The handle is further located close to the center of gravity of the entire tray assembly. This attachment location causes the entire tray assembly to be easily moved without the user having to resist the weight of the tray and its contents. The handle is also mounted on the container bottom in such a way that it does not interfere with mounting the tray to a step or removing the tray from a step. The ladder supported holding tray requires a minimum of materials to manufacture, and is durable in construction.

These and other advantages of the present invention will become apparent upon inspection of the accompanying specification, claims and drawings.

DRAWINGS

DESCRIPTION

Figures 1, 1A:
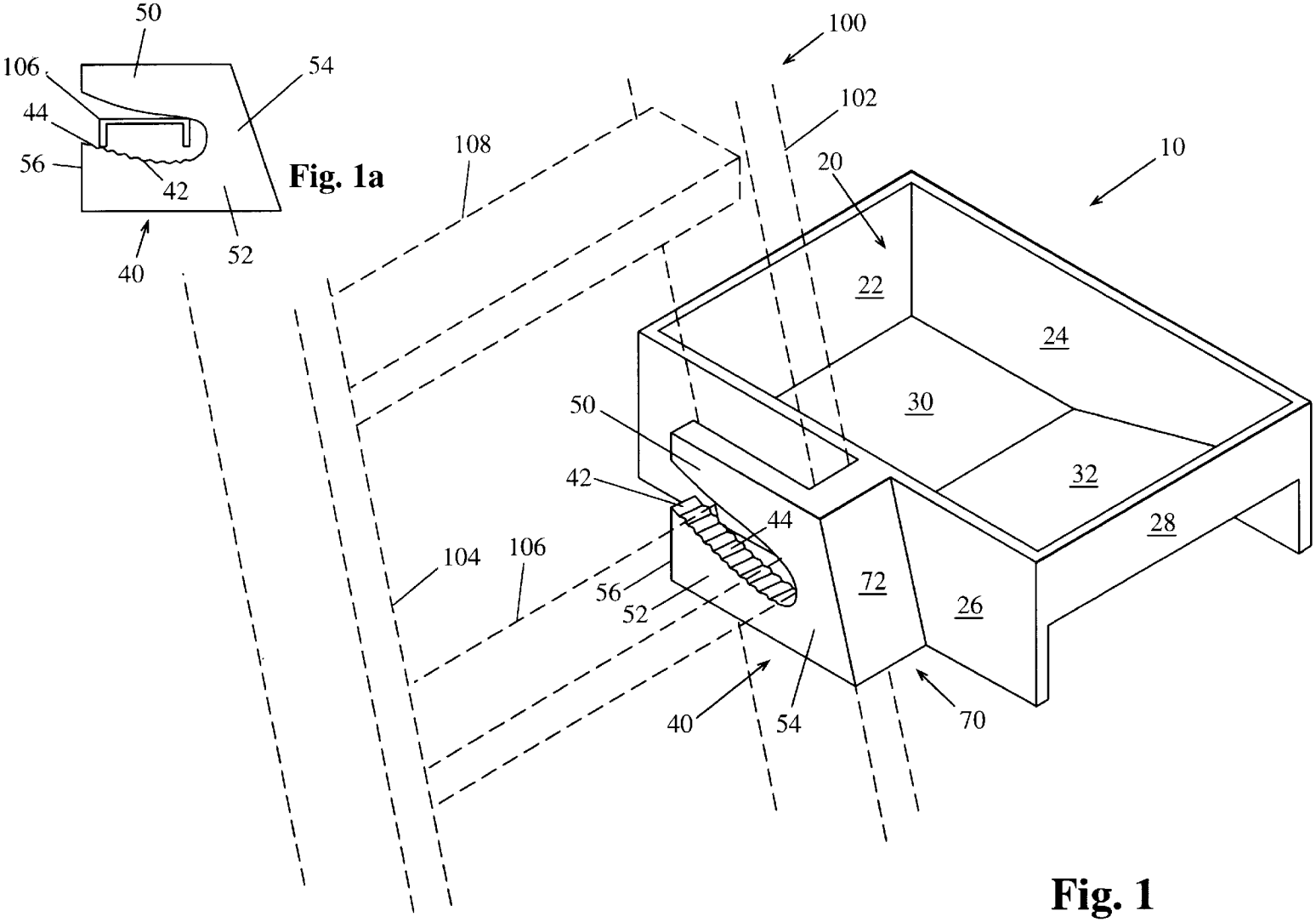
FIG. 1 is a perspective view of a preferred version of the ladder supported holding tray of the present invention attached to a step ladder.
FIG. 1A is a side view of the ladder engagement bracket of FIG. 1.
Figures 2, 2A:
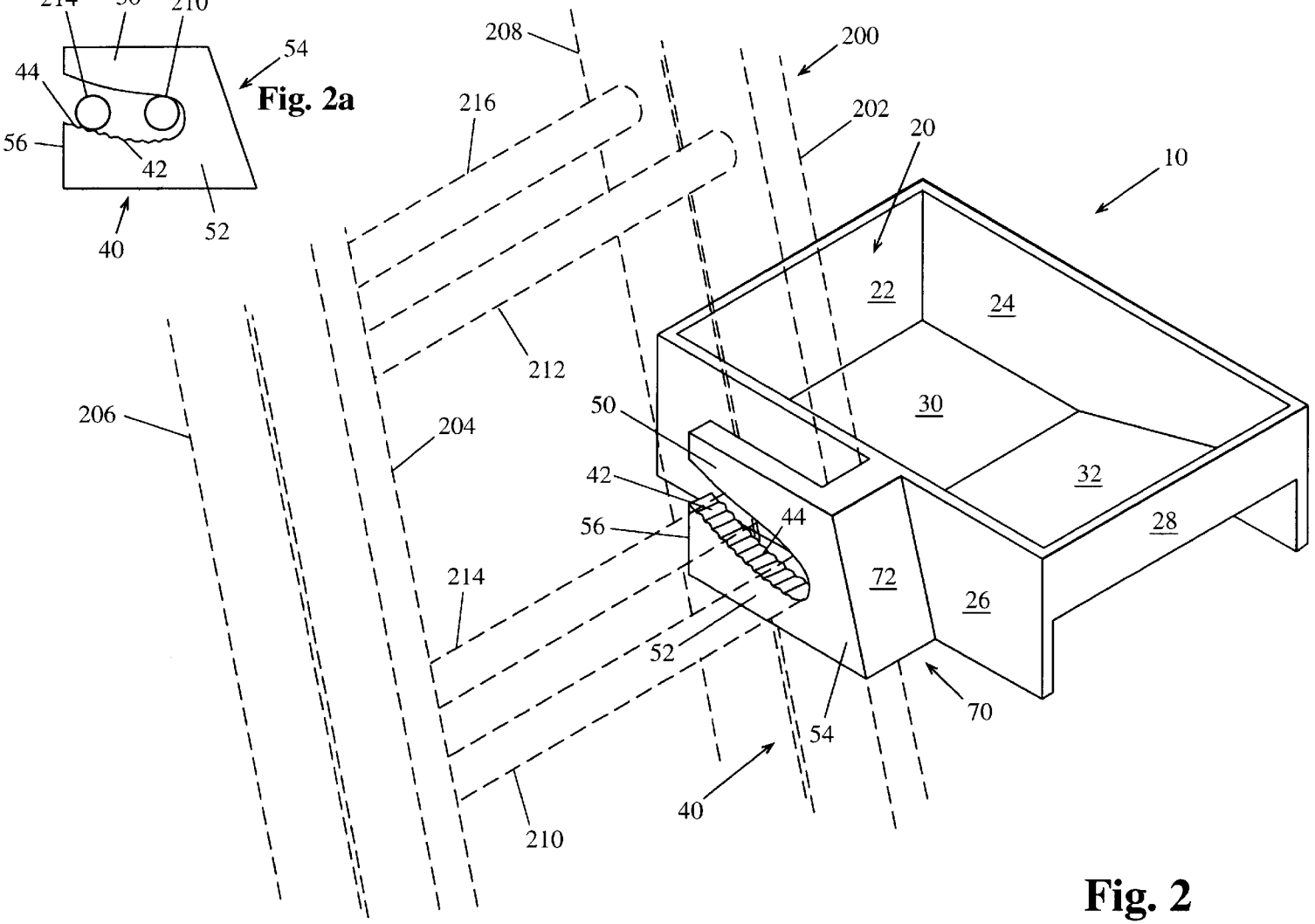
FIG. 2 is a perspective view of a preferred version of the ladder supported holding tray of the present invention attached to adjacent side by side rungs of overlapping sections of an extension ladder in a non-extended condition.
FIG. 2A is a side view of the ladder engagement bracket of FIG. 2.
Figures 3, 3A:
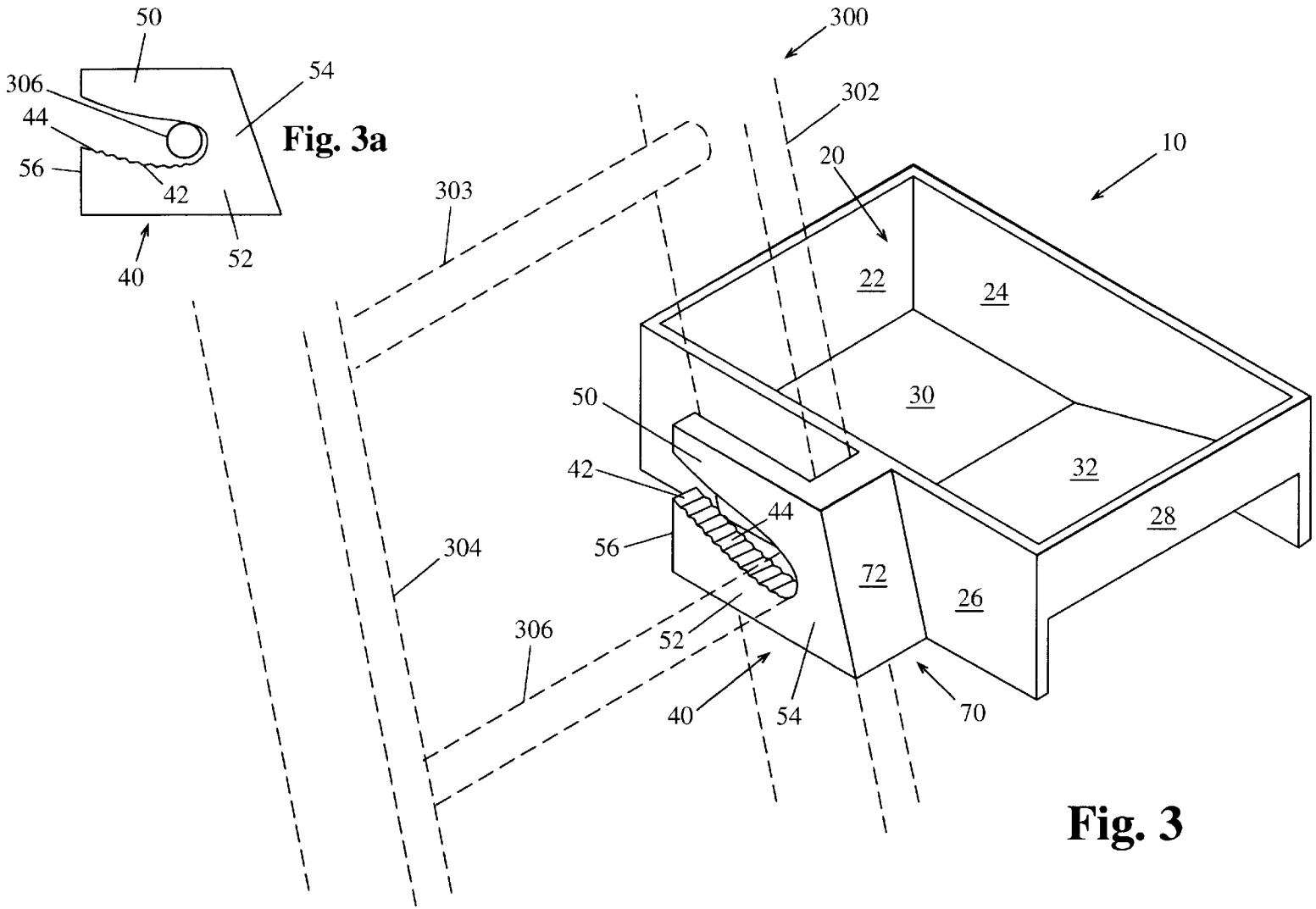
FIG. 3 is a perspective view of a preferred version of the ladder supported holding tray of the present invention attached to a single rung of an extension ladder in an extended condition.
FIG. 3A is a side view of the ladder engagement bracket of FIG. 3.
Figure 4:
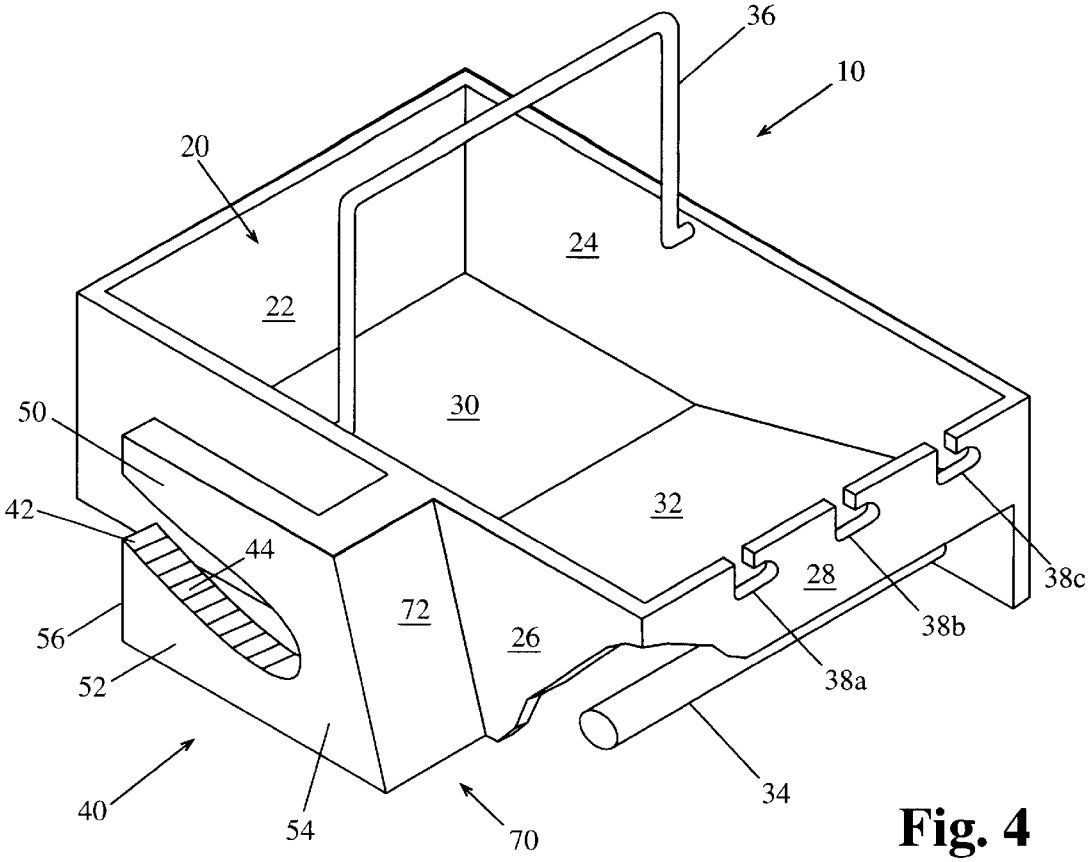
FIG. 4 is a perspective view of a preferred version of the ladder supported holding tray of the present invention showing two versions of handles.
Figure 4A:
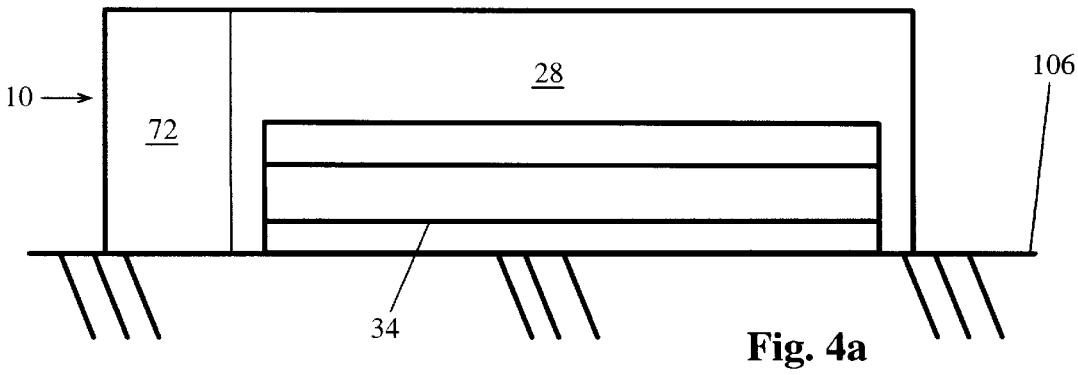
FIG. 4A is a front elevation of a preferred version of the ladder supported holding tray of the present invention supported on a flat surface.

Referring in more detail to the drawings, there is illustrated in FIGS. 1 to 4 a preferred version of the ladder supported holding tray of the present invention. FIGS. 1 to 3 show the ladder supported holding tray in releasable attachment to three types of ladders currently available on the market. FIG. 1 shows the ladder supported holding tray attached to a step ladder having a deep section metal step. FIG. 2 shows the ladder supported holding tray attached to adjacent side by side rungs of an extension ladder. FIG. 3 shows the ladder supported tray attached to a single rung of an extension ladder in a fully extended condition. FIGS. 1A, 2A, and 3A are side views showing the relationship between the step of each type of ladder and the ladder attachment bracket of the ladder supported holding tray. FIG. 4 shows two handle versions that may be used with the ladder supported holding tray. FIG. 4A shows an elevation view of the ladder supported holding tray supported on a flat surface and showing the attachment of the handle to the tray.

In greater detail, FIG. 1 shows the preferred version of the ladder supported holding tray 10 comprising a container 20 and a ladder attachment bracket 40 attached to a step ladder 100. Container 20 includes a back 22, a front 28, opposing side panels 24 and 26, and a bottom that includes paint basin bottom 30 and paint roller rolling surface 32. Attached to container 20 is a ladder attachment bracket 40 that includes connecting wall 70. Connecting wall 70 is inclined in relation to the generally horizontal container 20 at an angle similar to the angle of a ladder rail when in use. Connecting wall 70 includes a forward facing first side 72 and a rearward facing second side that also faces ladder rail 102. Connecting wall 70 spaces the ladder attachment bracket 40 away from the container side panel 26 by a suitable distance to accommodate side rail 102 of ladder 100.

Ladder attachment bracket 40 is shown attached to step 106 of ladder 100. Ladder attachment bracket comprises an upstanding wall and includes a top 50, a bottom 52, a front 54, and a back 56. Formed within ladder attachment bracket is a step engagement means that comprises concave upward sloping surface 42. Concave upward sloping surface 42 additionally includes means to prevent movement of the step engagement means in relation to a step, that as shown in FIG. 1, comprise a series of parallel ridges 44. The concave upward sloping surface 42 originates at a position proximate to the connecting wall 70 and extends therefrom in an upward sloping orientation to the back of the bracket. The concave upward sloping surface 42 that comprise the step engagement means is further separated from the top of the bracket by a step receiving recess defined by the gap between the upward sloping surface and the top of the bracket. Disposed within this step receiving recess in FIG. 1 is step 106.

FIG. 1A shows a side view of the ladder attachment bracket 40 with the step 106 disposed within the step receiving recess separating the concave upward sloping surface 42 and the bracket top 50. Also shown in FIG. 1A are ridges 44 that comprise the means to prevent movement of the step engagement means in relation to a step. Step 106 is in contact with the concave upward sloping surface 42 with ridges 44 providing an engagement surface which will prevent the rotation of the tray in relation to the step and also help retain the step in engagement to the concave upward sloping surface 42.

FIG. 2 shows the ladder supported holding tray 10 attached to an extension ladder 200 in a non-extended condition. Disposed within the step receiving recess of the ladder engagement bracket 40 are adjacent side by side rungs 210 and 214 of the two overlapping sections of the extension ladder 200. FIG. 2A shows a side view of the ladder engagement bracket with side by side rungs 210 and 214 disposed within the step receiving recess. Rung 214 is in engagement with the concave upward sloping surface 42 and is prevented from rotation therewith by ridges 44.

FIG. 3 shows the ladder supported holding tray 10 attached to an extension ladder 300 in an extended condition. Disposed within the step receiving recess of the ladder engagement bracket 40 is rung 306. Rung 306 is disposed as far into the step receiving recess as is possible until the rail 302 abuts against the rearward facing second side of the connecting wall 70. Connecting wall 70 is inclined at roughly the same angle as the angle of the rail 302 in relation to the ground. When the rail abuts against the rearward facing second side of the connecting wall 70, the tray 10 is prevented from rotation in relation to the rung 306. FIG. 3A shows the rung 306 in relation to the ladder engagement bracket 40.

FIG. 4. Shows two variations of handles used in conjunction with the ladder supported holding tray. Handle 34 is disposed under the tray container 20 and typically is attached to the opposing side panels 24 and 26. Handle 34 is disposed as close as possible to the tray center of gravity so as to provide the user the greatest amount of control on the tray when moving up or down a ladder with the tray 10. This handle 34 would typically be fixed on the tray and would provide the user with a very stable attachment point on the tray.

A second handle 36 may also be included with the ladder supported holding tray 10. This handle 36 would be used to permit carrying the tray much like a pail and would comprise a typical bail type handle as is used with paint buckets. The handle 36 would typically also be attached to the opposing side panels 24 and 26 of the container 20. This handle 36 would typically not be fixed to the tray and could be rotated away from the container when not being used.

FIG. 4 also shows paint roller handle retention slots 38*a*, 38*b*, and 38*c*. These slots are able to retain a paint roller handle and prevent a paint roller carried within the container 20 from movement when the user is carrying the tray or any time the user wishes to immobilize a paint roller within the tray. FIG. 4A is a front view of the tray 10 and shows the handle 34. FIG. 4A also shows the ability of the tray to rest on a flat surface.

Using the ladder supported holding tray 10 is simple. If desired, the paint basin of the container can be filled with paint before attachment to a ladder. The bottom surface of the opposing side panels 24 and 26 provide the tray with a stable base to support the tray of a flat surface. The tray does not require any extra support when filling the container paint basin as it is very stable when supported on a flat surface. Once filled, the user can easily lift the tray 10 by the handle 34 and proceed up the ladder.

Once the user has determined the location on the ladder where the tray will be attached, the user needs only to slide the rung, set of rungs, or step into the step receiving recess separating the step engagement means and the top of the ladder engagement bracket. To slide the tray 10 onto a rung, set of rungs, or step, the user need only to slightly tilt the tray so that the leading edge of the step engagement means will pass under the step. At the same time, the user moves the tray toward the ladder until the rung, set of rungs, or step are as far into the step receiving recess as possible. At this point, the first step engagement means has hooked under the rung, set of rungs, or step. The user then allows the weight of the tray to rotate the tray forward in relation to the step. The rotation will continue until the concave upward sloping surface of the step engagement means contacts the step or side by side stet of rungs. If the tray is being attached to a single rung of a ladder the user moves the tray onto the ladder until the ladder rail abuts the rearward facing second side of the connection wall 70. The tray is typically most stable when the outside surface of container side panel 26 also abuts the side rail of a ladder. At this point, the tray is securely attached to the ladder and the user can release the handle. At no time during the attachment of the tray to the ladder does the user have to reposition his or her hand on the handle. Additionally, the other hand of the user is not required for mounting the tray, so the user can maintain a firm hand hold on the ladder.

Releasing the tray from the step, rung, or set of rungs is as easy as securing the tray to a step, rung, or set of rungs. The user needs only to grab the handle and then pull the tray away from the ladder while slightly tilting the tray to release the step engagement means from the step, rung, or set of rungs.

Once secured to a ladder the tray is extremely stable. The tray is essentially locked on to the ladder and resists all movement in relation to the ladder. There is little chance of accidentally knocking the tray off the ladder as releasing the tray from the ladder requires the tray to be simultaneously tilted slightly and moved away from the ladder. The tray also resists side to side movement well and resists upward or downward movement as the ladder engagement bracket straddles above and below the step. Filling the tray with paint or supplies once the tray is secured to a ladder is easy due to the stability of the tray attachment to the ladder.

The ladder supported holding tray is easily manufactured using existing plastic molding techniques. The tray could be produced as a single piece or as multiple pieces that require a small degree of assembly. The tray container could be manufactured in a variety of sizes or shapes.

Although the tray of the preferred version of the invention as shown in FIGS. 1 to 4 is shown designed to accommodate a paint roller, the tray could be configured to accommodate other tools or hardware that could be used while on a ladder. It is also understood that various modifications and changes in form or detail could readily be made without departing from the spirit of the invention. It is therefore intended that the invention be not limited to the exact form and detail herein shown and describe, nor to anything less than the whole of the invention herein disclosed and as hereinafter claimed.

We claim:

1. In combination, a step ladder and a tray for releasable attachment to the step ladder comprising:

a step ladder including opposing side rails, a ladder top panel disposed between the opposing side rails, and a plurality of steps disposed between the opposing side rails at positions beneath the ladder top panel; wherein each step includes a flat top surface having a front and back edge, a front side comprising a surface attached to the flat top front edge and extending downwardly therefrom, a back side comprising a surface attached to the flat top back edge and extending downwardly therefrom, and wherein the front side and the back side each include a bottom edge; and wherein each step includes a width defined by the distance from the front side to the back side; and, wherein the area between the front side and the back side of each step is disposed in front of the back side of the step;

a tray attached to a selected step of the step ladder, the tray comprising:

a tray body; wherein the tray body extends laterally outwardly from the ladder from a position proximate to a first side rail of the ladder;

at least one step engagement means disposed on the tray body to permit secure temporary attachment of the tray to the ladder through secure temporary engagement to a single selected step of the step ladder;

wherein the step engagement means comprises a first section disposed substantially in front of the front side of the selected step; a second section attached to the first section and extending rearwardly from the first section above the top surface of the selected step; the second section including a distal free end; the second section further having a length such that the second section at least partially extends above the top surface of the selected step; and a third section attached to the first section and extending rearwardly from the first section underneath the selected step; the third section including a distal free end; the third section further having a length longer than the width of the selected step, such that the distal free end of the third section is disposed at a position behind the back side of the selected step; wherein the third section further includes an upward sloping surface; wherein the upward sloping surface begins at a location in front of the bottom edge of the back side of the selected step and wherein the upward sloping surface engages the bottom of the back side of the selected step; wherein the distal free end of the third section does not contact the top of the selected step; and, wherein the distal free end of the third section does not contact the distal free end of the second section; and, wherein the upward sloping surface slopes upwardly in relation to the flat top of the selected step; and wherein the tray body extends laterally outwardly from the ladder; and, wherein the tray body is substantially disposed on the opposite side of the first ladder side rail than the step engagement means.

2. The combination of claim 1, wherein the upward sloping surface is concave.

3. The combination of claim 1, wherein the tray body includes a container.

4. The combination of claim 1, wherein the tray body includes a platform.

5. The combination of claim 1, further comprising a ladder attachment bracket and wherein the step engagement means is disposed on the ladder attachment bracket.

6. The combination of claim 5, wherein the tray further includes means for attaching the ladder attachment bracket to the tray body; wherein the means for attaching the ladder attachment bracket to the tray body extends in front of the first ladder side rail.

7. In combination, an extension ladder having multiple sections and a tray for releasable attachment to the extension ladder comprising:

an extension ladder having at least front and back sections; and wherein at least a portion of the front and back sections are in an overlapping orientation; each ladder section including opposing side rails and a plurality of substantially round rungs disposed between the opposing side rails; wherein each rung includes a top for foot support, a bottom, a front and a back; wherein the overlapping front and back sections of the ladder include a plurality of adjacent side by side pairs of front and back rungs; and wherein each pair of adjacent side by side rungs defines a single step having a width defined by the distance from the front of the front rung to the back of the back rung;

a tray attached to the extension ladder, the tray comprising:

a tray body; and at least one step engagement means disposed on the tray body to permit secure temporary attachment of the tray to the ladder through secure temporary engagement to a single selected step of the extension ladder;

wherein the step engagement means comprises a first section disposed substantially in front of the front rung of the selected step; a second section attached to the first section and extending rearwardly from the first section above the selected step; the second section including a distal free end; the second section further having a length such that the second section at least partially extends above the front rung of the selected step; and a third section attached to the first section and extending rearwardly from the first section underneath the selected step; the third section including a distal free end; the third section further having a length longer than the width of the selected step, such that the distal free end of the third section is disposed at a position behind the back rung of the selected step; wherein the third section further includes an upward sloping surface; wherein the upward sloping surface begins at a location in front of the back rung of the selected step, and wherein the upward sloping surface engages the bottom of the back rung of the selected step; wherein the distal free end of the third section does not contact the top of the back rung of the selected step; and, wherein the distal free end of the third section does not contact the distal free end of the second section; and, wherein the upward sloping surface slopes upwardly in relation to a plane connecting the tops of the front and back rungs of the selected step; and, wherein the tray body extends laterally outwardly from the ladder; and, wherein the tray body is substantially disposed on the opposite side of the first ladder side rail than the step engagement means.

8. The combination of claim 7, wherein the upward sloping surface is concave.

9. The combination of claim 7, wherein the tray body includes a container.

10. The combination of claim 7, wherein the tray body includes a platform.

11. The combination of claim 7, further comprising a ladder attachment bracket and wherein the step engagement means is disposed on the ladder attachment bracket.

12. The combination of claim 11, wherein the tray further includes means for attaching the ladder attachment bracket to the tray body; wherein the means for attaching the ladder attachment bracket to the tray body extends in front of the first ladder side rail.

* * * * *